United States Patent [19]

Hida

[11] Patent Number: 5,020,336

[45] Date of Patent: Jun. 4, 1991

[54] ICE MAKING MACHINE

[75] Inventor: Junichi Hida, Toyoake, Japan

[73] Assignee: Hoshizaki Electric Co., Ltd., Toyoake City, Japan

[21] Appl. No.: 483,934

[22] Filed: Feb. 22, 1990

[51] Int. Cl.[5] ..... F25C 5/18

[52] U.S. Cl. ..... 62/344; 285/189; 414/299

[58] Field of Search ..... 62/344, 354; 222/540; 285/158, 189, 201; 414/299

[56] References Cited

U.S. PATENT DOCUMENTS

| | | | |
|---|---|---|---|
| 737,182 | 8/1903 | Webster | 285/189 X |
| 1,292,812 | 1/1919 | Lachman | 285/189 X |
| 3,815,214 | 6/1974 | Kyle Sr. | 285/189 X |
| 4,662,182 | 5/1987 | Tsukiyama et al. | 62/344 X |

*Primary Examiner*—William E. Tapolcai

*Attorney, Agent, or Firm*—Brooks Haidt Haffner & Delahunty

[57] ABSTRACT

An ice making machine comprises an ice storage section and an ice making machinery section disposed on the ice storage section through a bottom plate having an opening therein. The machinery section includes an ice discharge chute that extends downwardly through the opening and opens into the interior of the ice storage section. The bottom plate is provided with an upwardly concaved recess in which the opening is formed. The ice discharge chute projects through the opening to a depth smaller than that of the recess.

4 Claims, 3 Drawing Sheets

ICE MAKING MACHINE

BACKGROUND OF THE INVENTION

1. Field of the Invention

This invention generally relates to an ice making machine and particularly to an ice maker of such a type in which an ice making machinery section thereof is disposed on an ice storage section in which ice produced by the ice making machinery section is stored.

2. Prior Art

In the hitherto known ice making machine of the above-mentioned type, as illustrated in FIG. 3 of the accompanying drawings, the upper machinery section includes a bottom plate 6, which is provided underneath a platform or base plate 5 and serves as the ceiling wall of the ice storage bin of the lower ice storage section. The base plate 5 is adapted to support the ice making mechanical elements including a refrigeration system (not shown). By the provision of such a dual-plate structure, both heat insulation of the ice storage bin and prevention of dust deposition therein can be realized. An ice discharge chute 3 which is a member in the upper machinery section is fitted into an opening 5*b* formed in the base plate 5 and an opening 6*b* of the bottom plate 6, wherein the ice discharge chute 3 is supported on the base plate 5 at a radially enlarged bulge portion 3*d* of the chute 3 by simply disposing it on the base plate 5 or by bonding. A gasket 7 is mounted around the opening 6*b* of the bottom plate 6 for hermetically closing a gap which would otherwise appear between the outer cylindrical surface 3*c* of the lower end portion 3*b* of the ice discharge chute 3 and the opening 6*b* of the bottom plate 6, in order to prevent leakage of cool air from and invasion of dust into the ice storage bin.

In the above machine, the opening 6*b* formed in the bottom plate 6 and the bottom end of the ice discharge chute 3 are positioned on the same plane in a state ready for the ice making operation after assembly. As a result, although a major portion of water droplets produced within the ice discharge chute 3 due to melting of ice particles or for other reasons drops through the bottom end 3*b* of the ice discharge pipe 3 into the ice storage bin, the remaining part of the water droplets may move along the lower surface 6*a* of the bottom plate 6, i.e. the ceiling wall of the ice storage bin after crossing the gasket 7 (refer to an arrow 11 in FIG. 3). When the droplets on the ceiling wall of the ice storage bin evaporate, traces are formed on the ceiling wall due to deposition of impurities contained in the water droplets, which are unsanitary in appearance. It should be noted that ice formed of water containing a greater amount of impurities is inherently easier to melt.

The above disadvantage can certainly be eliminated by extending the ice discharge chute 3 to such an extent that the bottom end 3*b* thereof projects below the bottom plate 6 to thereby prevent the water droplets from migrating or propagating onto the lower surface 6*a* of the bottom plate 6. In that case, however, a downwardly projecting portion is formed on the lower surface of the bottom plate 6 of the machinery section. It is to be noted that for an ice making machine having an ice making machinery section disposed on the ice storage section, the ice making machinery section incorporating therein the ice discharge chute 3 is commonly packed separately from the ice storage section for convenience during transportation to a required location. Thus, the presence of the downwardly projecting portion makes the packing of the ice making machinery section troublesome. Further, precautions must be taken so that the projecting portion is not damaged during transportation, which is clearly undesirable.

SUMMARY OF THE INVENTION

It is therefore an object of the present invention to provide an ice making machine in which the droplets resulting from melting of ice are positively prevented from moving onto the lower surface of the bottom plate and which has no projections protruding from the bottom plate which provide obstacles to the packing and transportation of the ice making machinery section having assembled therein the ice discharge chute.

With the above object in view, the invention provides an ice making machine which comprises an ice storage section disposed at a lower position, and an ice making machinery section including a bottom plate having an opening formed therein, the machinery section being positioned above the ice storage section with the bottom plate thereof disposed on the ice storage section. The ice making machinery section further includes ice discharge means, and an ice discharge chute having an upper end portion communicated with the ice discharge means and a lower end portion communicated through the opening in the bottom plate with the interior of the ice storage section. The bottom plate has an upwardly concaved portion, in which the opening is formed, to define a recess. The lower end portion of the ice discharge chute extends downwardly into the recess through the opening only to such an extent that the bottom end of the lower end portion thereof does not project downwardly beyond the lower surface of the bottom plate.

By virtue of the provision of the upwardly concaved recess in the bottom plate of the ice making machinery section so as to allow the ice discharging chute to extend through the opening formed in the concaved bottom plate portion, the water droplets resulting from the melting of ice within the ice discharge chute are positively prevented from moving or propagating onto the lower surface of the bottom wall, whereby all he droplets are forced to drop into the ice storage section from the bottom end of the ice discharge chute, leaving no traces of evaporization on the lower surface of the bottom plate (i.e. the ceiling wall of the ice storage section).

Further, as the depth to which the ice discharging pipe is allowed to extend into and through the recess is so selected as to be smaller than the depth of the recess, no obstacles resulting from the projection will be encountered in the packing and transportation of the ice making machinery section having assembled therein the ice discharge chute. This significantly facilitates the packing and transportation.

BRIEF DESCRIPTION OF THE DRAWINGS

A more detailed understanding of the present invention may be had from the following description of a preferred embodiment thereof, given by way of example, and to be read and understood in conjunction with the accompanying drawings, in which:

FIGS. 4A and 4B are views of the strut and fairing taken from near the front and the rear thereof.

FIGS. 5A and 5B, respectively, are a plan view of the strut and fairing with the top section removed and an end view of a portion of a discharge chute of the fairing.

FIGS. 6A through 6C show in sketch and graph form the improved flow dynamics within a diffuser in accordance with one embodiment of the present invention.

DETAILED DESCRIPTION OF THE INVENTION

Figure 1:
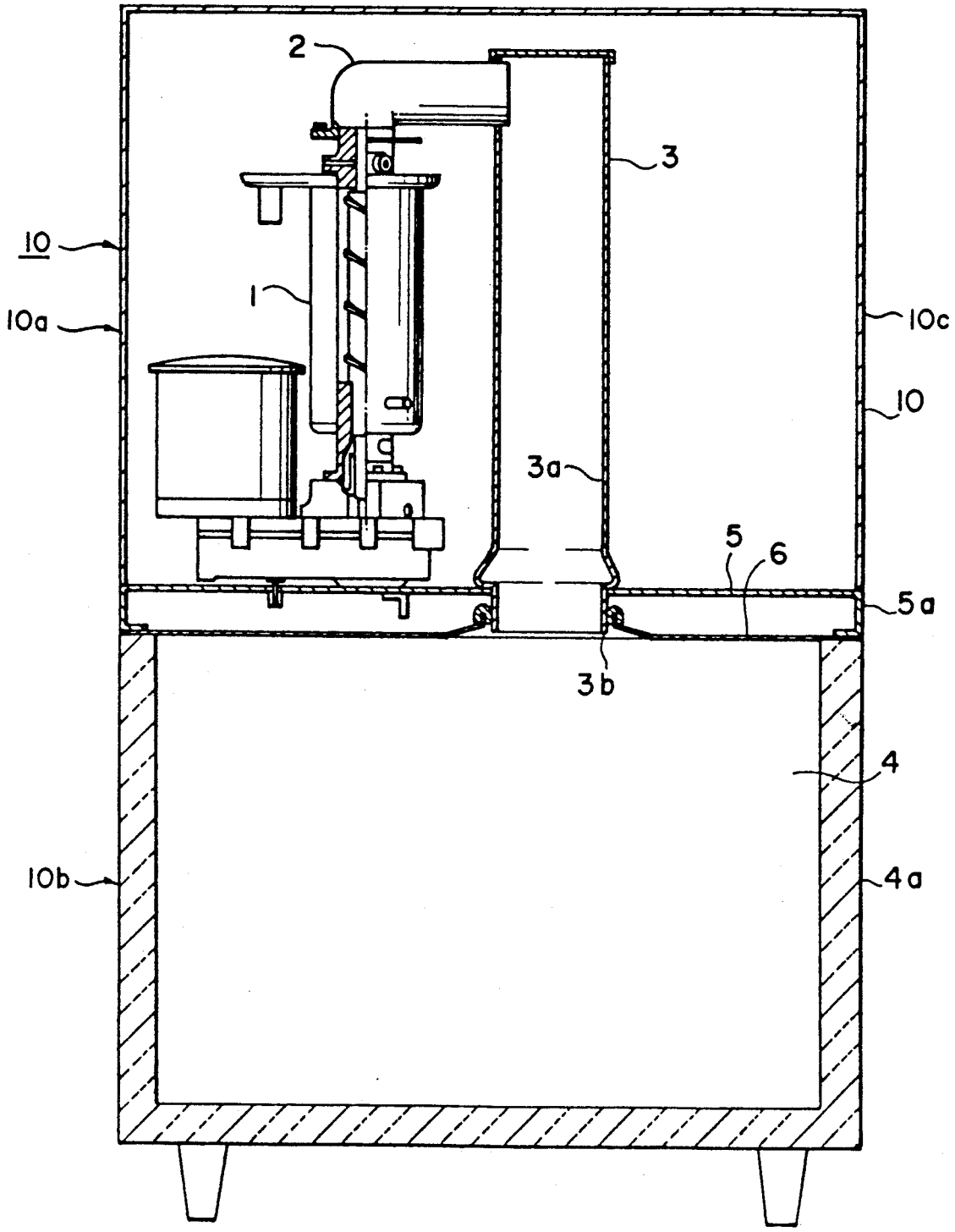
FIG. 1 is a sectional view generally showing a whole structure of an ice making machine according to a preferred embodiment of the invention.

FIG. 1 is a cross section view of a gas turbine engine 11. The engine 11 is an axial flow engine of the type which is referred to as a bypass or turbofan engine, although it should be appreciated that the present invention could be applied to other types of engines. The engine 11 includes an air intake 13 and an exhaust outlet 15, thus establishing the general flow direction through the engine. The intake 13 houses a conventional low pressure compressor (LPC) 17 at the forward end of the engine. Downstream of the LPC 17, the engine 11 is divided into two generally cylindrical casings including a radially inner casing 19 and a surrounding outer casing 21. Part of the LPC discharge flow is directed into an annular bypass air passage, or duct 23. The inner casing 19 includes a conventional gas generator 25 which comprises, in series connection, a high pressure compressor (HPC) 27, a combustor 29, a high pressure turbine (HPT) 30, and a low pressure turbine (LPT) 31. The HPT 30 drives the HPC 27, whereas the LPT 31 drives the LPC 17 through coaxial first and second shafts 32 and 34, respectively. Fuel is provided to the combustor 29 by means of fuel pipes 33. The volume downstream from the casing 19 may be considered as the turbine discharge passage, or outlet, 35.

An annular support structure, or simply support, 37, in accordance with one embodiment of the invention, is positioned at the turbine outlet 35 and will be described in greater detail with reference to the other FIGURES. An outer support member 39 of conventional design is positioned in the bypass duct 23. A conventional mixer 41, which may be of annular or daisy (radial lobe) configuration, is provided between the bypass duct 23 and the turbine outlet 35 for mixing cool LPC discharge air with hot turbine discharge gases. In the exemplary embodiment illustrated, the engine 11 includes a conventional afterburner 151, having a plurality of afterburner fuel pipes 43 for feeding fuel to the afterburner 151. At least one annular flameholder 45 is positioned downstream of the afterburner fuel pipes 43. But for the support structure 37, the remainder of the engine 11 is conventional, including an adjustable exhaust nozzle 51 and a centerbody 53 disposed in the turbine outlet 35 and afterburner 151.

Figure 2:
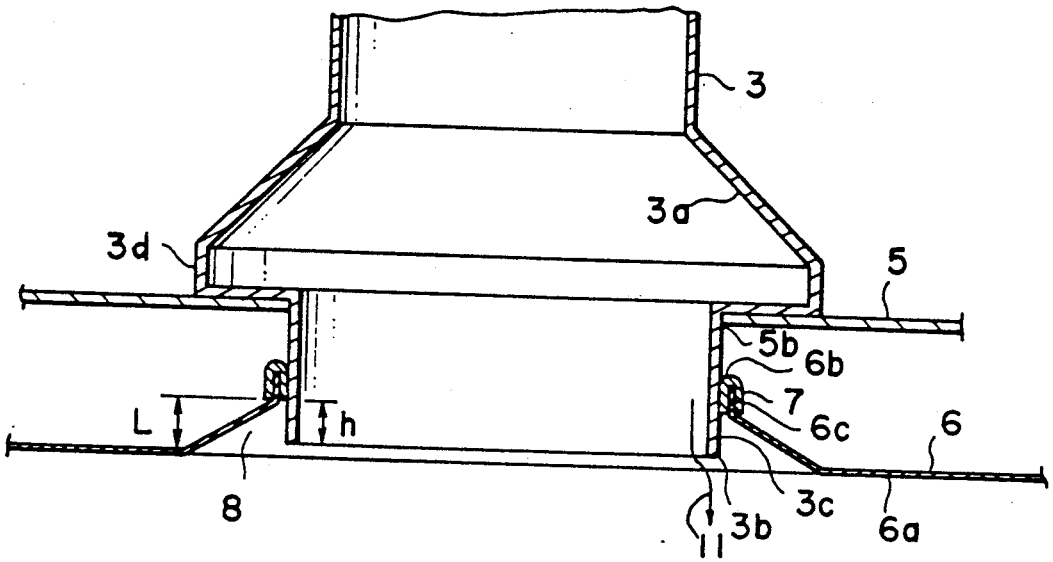
FIG. 2 is an enlarged sectional view of a major portion of the ice making machine shown in FIG. 1.

An exemplary embodiment of the invention will be described with first reference to FIG. 2. FIG. 2 shows primarily the support 37, with the point of reference being a view looking upstream into the engine 11 from the afterburner 151, as shown by line 2-2 in FIG. 1. The support structure 37 comprises a radially inner ring 61 and a radially outer ring 65, connected together by a plurality of radial members or fairings 67 extending therebetween. The inner ring 61 supports a conventional rear engine bearing casing 71 (FIG. 1), whereas the outer ring 65 supports the casing 19. The support 37 is disposed in the turbine outlet 35 on the downstream side of the LPT 31. Each of the fairings 67 includes a wing or mixing chute 75, which will be described in greater detail during the following further description.

Figure 3:
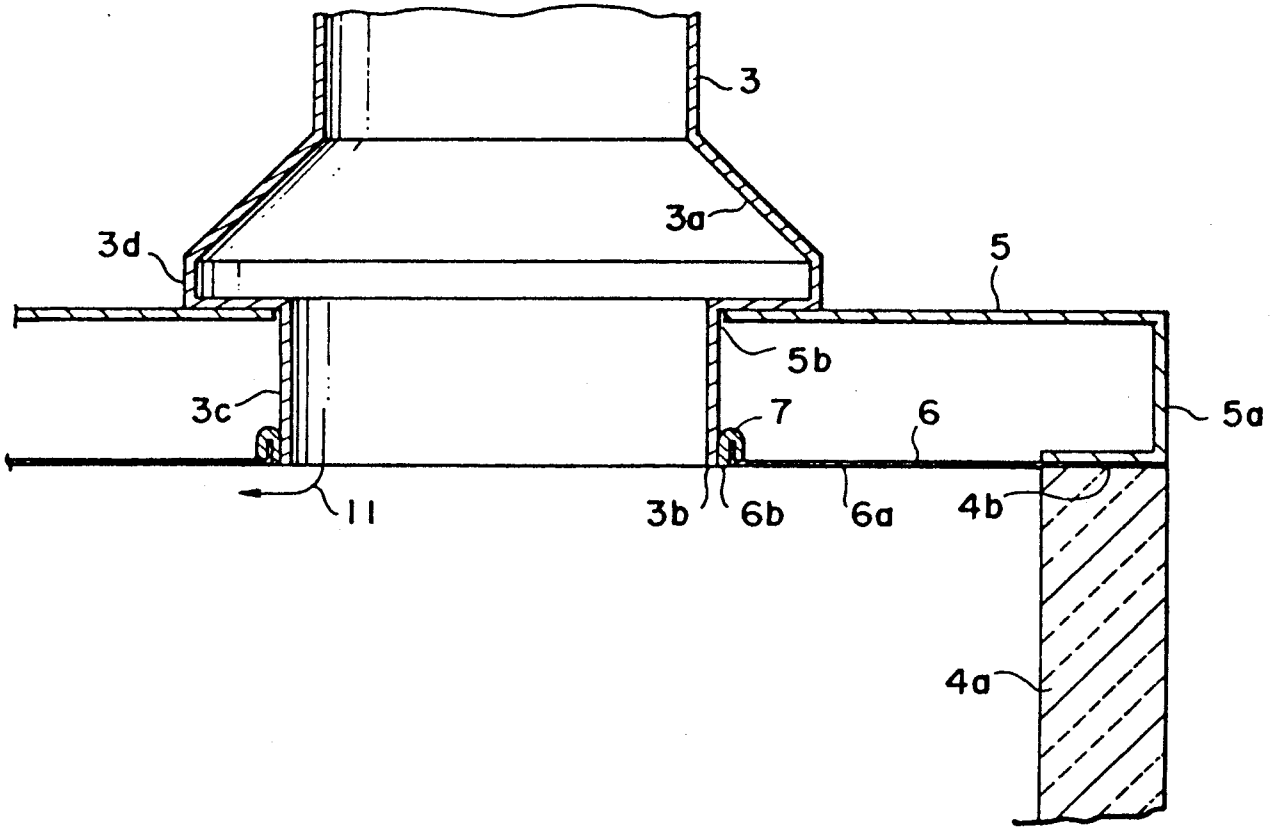
FIG. 3 PRIOR ART

FIG. 3 is an elevation view in cross section of a portion of the support 37, showing, in particular, one of the fairings 67. The fairing 67 is shown as partially cut away so as to identify various fluid flowpaths. The fairing 67 is aligned with the gas discharge of the LPT 31 and is positioned in the turbine outlet 35. The inner casing 19 and the outer casing 21 are shown so as to define the annular bypass duct 23. The fairing 67 itself will be further described with respect to FIGS. 3, 4A, 5A and 5B so as to give a full appreciation as to its structure. The fairing includes an outer surface 81 in the shape of an airfoil which extends radially between the inner and outer rings 61, 65 of the support 37. As is best evident from FIG. 4A, each fairing 67 may include a radially inner skirt 83 and a radially outer skirt 85 which provide structures for fastening the fairing to the inner and outer rings 61, 65, respectively.

FIGS. 5A and 5B, in connection with FIGS. 3, 4A and 4B, best show that the fairing 67 includes a hollow inner chamber 89. The chamber 89 extends the entire axial width of the fairing from a leading edge 91 to a trailing edge 93 of the fairing. A hollow structural inner member, or support strut, 95 is positioned within the chamber 89 and attached to rings 61 and 65 to provide the structural support. The strut 95 includes an inner flowpath 97 through which cooling air (shown solid arrows) may be conventionally channeled to inner engine parts such as the rear bearing 71. This flowpath 97 may also be used as a channel for lubrication lines (not shown) which also benefit from the cooling airflow.

The chamber 89 of the fairing 67 also includes a pair of baffles which direct cooling air from the leading edge 91 to the trailing edge 93 of the fairing 67. An upstream baffle 101 is followed by a downstream baffle 103 with respect to the direction of the fluid flow through the fairing. An upstream baffle 101 extends from the radially outer edge of, and partially into, the fairing 67, whereas the downstream baffle 103 extends from the radially inner edge of, and partially into, the fairing 67 so as to create a circuitous flowpath from the leading edge 91 of the fairing 67 to the trailing edge 93 inside the fairing 67, as best seen in FIG. 3. The circuitous flowpath may be regarded as a three-pass cooling path within the fairing 67. As is clearly shown in FIG. 4B taken in combination with FIG. 3 a relatively small portion of the cooling flow is exhausted out the trailing edge 93 of the streamlined member through a plurality of air bleed holes 107 to ensure flow of cooling air through the fairing 67 for the cooling thereof.

Each fairing 67 is formed with means for discharging cooling air in a downstream direction, which means include the chute 75, as has been pointed out with reference to FIGS. 4A and 4B and which is more particularly shown in FIGS. 5A and 5B. FIG. 5A is a plan view of the fairing 67 with the radially outer skirt 85 removed for clarity. More specifically, and additionally with reference to FIG. 5B, the chute 75 includes a width dimension, taken in the circumferential direction, which is substantially greater than its height dimension taken in the radial direction. The chute 75 is in the form of a delta-wing which is made part of the fairing 67. The chute 75 is a cooling air discharge formed with the fairing 67 and generally perpendicular thereto. The lateral trailing edge of the chute 75 is preferably aligned generally perpendicularly to a radial axis, and the trailing edges of adjacent chutes 75 are disposed in a single formed to that of the outer circumferential surface 3*c* of the lower end portion 3*b* of the ice discharge chute 3.

It will be appreciated from the foregoing that according to the invention, as the upwardly concaved recess is provided in the bottom plate of the ice making machinery section and as the ice discharge chute is so disposed that the lower end portion thereof extends within the recess over a distance which is shorter than the depth of the recess, the droplets produced within the ice discharge chute are positively prevented from propagating onto the lower surface of the bottom plate or the ceiling wall of the ice storage chamber and unavoidably forced to drop within the ice storage chamber from the lower end portion of the ice discharge chute. Thus, there is formed on the ceiling wall of the ice storage chamber no trace of the deposition resulting from vaporization of the water droplets. Also, no part of the ice discharge chute projects from the bottom plate upon installation of the ice discharge chute on the ice making machinery section, as a result of which the packing and transportation of the latter can be greatly facilitated.

It is felt that the present invention will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. An ice making machine, comprising:

a lower ice storage section defining an ice storage chamber therein;

an upper ice making machinery section including a bottom plate having a lower surface, an opening formed therethrough and ice discharge means housed in said ice making machinery section for discharging ice produced in said ice making machinery section therefrom, said ice making machinery section having its said bottom plate disposed on said ice storage section, said ice discharge means including an ice discharge chute having a lower end portion extending downwardly through said bottom plate opening to communicate with said ice storage chamber; and wherein a portion of said bottom plate at which said opening is formed is concaved upwardly surrounding said opening to thereby define a recess of said bottom plate into which said lower end portion of said ice discharge chute extends to such an extent that the bottom end of said lower end portion of said ice discharge chute terminates at a level below said opening and above the lower surface of said bottom plate.

2. An ice making machine according to claim 1, wherein said lower end portion of said ice discharge chute extends into said recess for a distance of about 2 mm to 3 mm downwardly from said opening.

3. An ice making machine according to claim 1, wherein said lower end portion of said ice discharge chute extends into said recess for a distance in excess of 3 mm downwardly from said opening.

4. An ice making machine according to claim 1, wherein said upper ice making machinery section and said lower ice storage section are removably connected to each other.

* * * * *